US006526786B1

(12) United States Patent
Kayoda

(10) Patent No.: US 6,526,786 B1
(45) Date of Patent: Mar. 4, 2003

(54) PROTECTIVE LOCK BOX COVER

(76) Inventor: Debra L. Kayoda, 21751 Shasta Lake Rd., Lake Forest, CA (US) 92630

( * ) Notice: Subject to any disclaimer, the term of this patent is extended or adjusted under 35 U.S.C. 154(b) by 0 days.

(21) Appl. No.: 10/039,262

(22) Filed: Jan. 3, 2002

Related U.S. Application Data

(60) Provisional application No. 60/259,817, filed on Jan. 4, 2001.

(51) Int. Cl.[7] ..... E05B 67/38

(52) U.S. Cl. ..... 70/56; 70/14; 70/63; 70/55

(58) Field of Search ..... 70/54–56, 14, 70/18, 63

(56) References Cited

U.S. PATENT DOCUMENTS

| | | | | | |
|---|---|---|---|---|---|
| 1,244,404 | A | * | 10/1917 | Ankovitz | 70/56 X |
| 1,581,953 | A | * | 4/1926 | Jackson | 70/56 X |
| 1,662,612 | A | * | 3/1928 | Junkunc | 70/55 |
| 2,828,157 | A | * | 3/1958 | Fox et al. | 70/55 X |
| 3,559,429 | A | * | 2/1971 | Hermann | 70/54 |
| 3,858,419 | A | * | 1/1975 | Hampton | 70/55 |
| 4,134,280 | A | * | 1/1979 | Pelavin | 70/55 |
| 4,297,861 | A | * | 11/1981 | Dykes | 70/55 |
| 4,317,344 | A | * | 3/1982 | Barnard | 70/55 |
| 4,534,190 | A | * | 8/1985 | Stanich | 70/54 |
| 4,651,543 | A | * | 3/1987 | Heald et al. | 70/54 |
| 4,897,945 | A | * | 2/1990 | Webb | 40/331 |
| 4,926,662 | A | * | 5/1990 | Gaudet | 70/56 |
| 5,003,795 | A | * | 4/1991 | Hoke | 70/55 |
| 5,046,339 | A | | 9/1991 | Krell | 70/55 |
| 5,218,846 | A | * | 6/1993 | Cook et al. | 70/56 |
| 5,275,028 | A | * | 1/1994 | Giarrante | 70/56 |
| 5,426,959 | A | * | 6/1995 | Kies | 70/56 |
| 5,477,710 | A | * | 12/1995 | Stefanutti | 70/56 |
| 5,615,567 | A | * | 4/1997 | Kemp | 70/455 |
| 5,638,707 | A | | 6/1997 | Gould | 70/56 |
| 5,775,149 | A | * | 7/1998 | Small | 70/63 X |
| 5,875,659 | A | * | 3/1999 | Nosse | 70/56 |
| 5,924,314 | A | * | 7/1999 | Cernansky | 70/56 |
| 6,192,721 | B1 | * | 2/2001 | Monteleone | 70/55 |
| 6,330,816 | B1 | * | 12/2001 | O'Connor | 70/63 |

* cited by examiner

*Primary Examiner*—Suzanne Dino Barrett
(74) *Attorney, Agent, or Firm*—Knobbe Martens Olson & Bear LLP

(57) ABSTRACT

A protective cover for a realtor's lock box is provided. The cover comprises a substantially rectangular assembly of panels, wherein at least some of the panels include a resilient layer that protects the lock box from impacts and protects objects that impact the lock box. The cover may also include one or more straps, and the straps may be releasably attached to one or more of the panels. The cover includes an opening at a bottom end to allow a key compartment to eject from the lock box. In a preferred embodiment, the cover includes a sleeve for storing realtor's business cards.

2 Claims, 5 Drawing Sheets

PROTECTIVE LOCK BOX COVER

RELATED APPLICATION

This application claims priority to provisional application Serial No. 60/259,817, filed on Jan. 4, 2001.

BACKGROUND OF THE INVENTION

1. Field of the Invention

The present invention relates to devices for protecting a real estate agent's lock box and the object to which the lock box is connected (usually a front door). Specifically, the present cover provides a flexible, cushioning sleeve for a lock box that protects both the box and also objects that could be damaged by the box.

2. Description of the Related Art

Real estate agents usually use a lock box to secure a key to a property that is listed for sale. An exemplary lock box includes an electronic keypad on a front surface. When authorized real estate agents and service personnel enter the proper code into the keypad, the lock box releases the secured key so that the property may be accessed. Other common lock boxes include access means other than an electronic keypad. For example, one type of lock box includes an infrared sensor on a front surface. Authorized personnel open the lock box using an infrared transmitting device, such as a handheld keypad.

Lock boxes are typically manufactured with a hard rubberized casing known to mark up, dent and ding the object from which they hang (usually a front door to a house). In addition, these lock boxes can be damaged, and cause damage, when they roll around inside the trunk of a real estate agent's vehicle. The boxes also weather poorly, collecting dirt and suffering other damage as a result of being exposed to the elements. When a lock box becomes damaged to the point that it is not pleasing to the eye, most real estate agents will replace the lock box, at their own expense, even if the lock box is still perfectly functional. The real estate business is highly competitive, and any unattractive feature, even something as seemingly minor as an unsightly lock box, can have a negative impact on the real estate agent's ability to make a sale. Thus, the rapid weathering of lock boxes can put a financial strain on struggling real estate agents. Further, when a lock box causes damage to a door from which it hangs, someone, most often the home buyer, must pay to have the damage repaired. Thus, the damage potential of lock boxes can cause new home buyers unnecessary aggravation and financial detriment.

Previous attempts at protecting lock boxes, and at protecting objects from lock boxes, have comprised plastic "cards" that hang on the front and on the back of the lock box. These cards are not aesthetically appealing and do not stay securely on the lock box.

U.S. Pat. No. 5,046,339 to Krell discloses a molded foam protective cover. However this design tends to be fragile and break or dent when impacted. It also is not adapted to work with the newer electronic lock box configuration, which dispenses the key by opening at the bottom. The Krell design blocks the bottom from opening, making the design impractical for use with modem lock boxes. Further, this cover, which is made from molded foam, is likely to crack and fade after exposure to the elements, and is likely to dent and crack as a result of being bounced around in the trunk of a moving car.

Thus, a cover for a lock box that is compatible with modem electronic lock boxes, and is durable and resistant to cracking, fading and denting, would be a great benefit to real estate agents and home buyers.

SUMMARY OF THE INVENTION

The preferred embodiments of the protective lock box cover have several features, no single one of which is solely responsible for their desirable attributes. Without limiting the scope of this protective lock box cover as expressed by the claims that follow, its more prominent features will now be discussed briefly. After considering this discussion, and particularly after reading the section entitled "Detailed Description of the Preferred Embodiments," one will understand how the features of the preferred embodiments provide advantages, which include compatibility with modem lock boxes, durability and resistance to cracking, fading and denting, and provision of a compartment for holding the realtor's business cards.

A preferred embodiment of the protective cover for a realtor's lock box comprises a rear panel, a right-side panel adjacent a first edge of the rear panel, and a left-side panel adjacent a second edge of the rear panel opposite the first edge. At least one strap is connected at a first end adjacent a lower-front corner of the right-side panel, and is connected at a second end to a lower-front corner of the left-side panel. The strap provides the fourth boundary to an opening in a bottom end of the cover.

Another preferred embodiment comprises a covered lock box system. The system comprises a lock box including a back panel, first and second side panels, a front panel, a bottom panel and a top panel. The front panel includes a key pad for entering an access code. The bottom panel opens outwardly upon entry of the access code. The top panel has a locking member for securing the lock box to a door opener. The system further comprises a protective jacket comprising a resilient material and at least one strap. The jacket is adapted to cover a portion of the top, back and side panels of the lock box, whereby the key pad and opening bottom panel remain substantially uncovered. Further, the portion of the jacket covering the top panel does not impede operation of the locking member, and the at least one strap is adapted to secure the jacket to the lock box.

BRIEF DESCRIPTION OF THE DRAWINGS

The preferred embodiments of the protective lock box cover, illustrating its features, will now be discussed in detail. These embodiments depict the novel and non-obvious protective lock box cover shown in the accompanying drawings, which are for illustrative purposes only. These drawings include the following figures, in which like numerals indicate like parts.

DETAILED DESCRIPTION OF THE PREFERRED EMBODIMENTS

Figure 1:
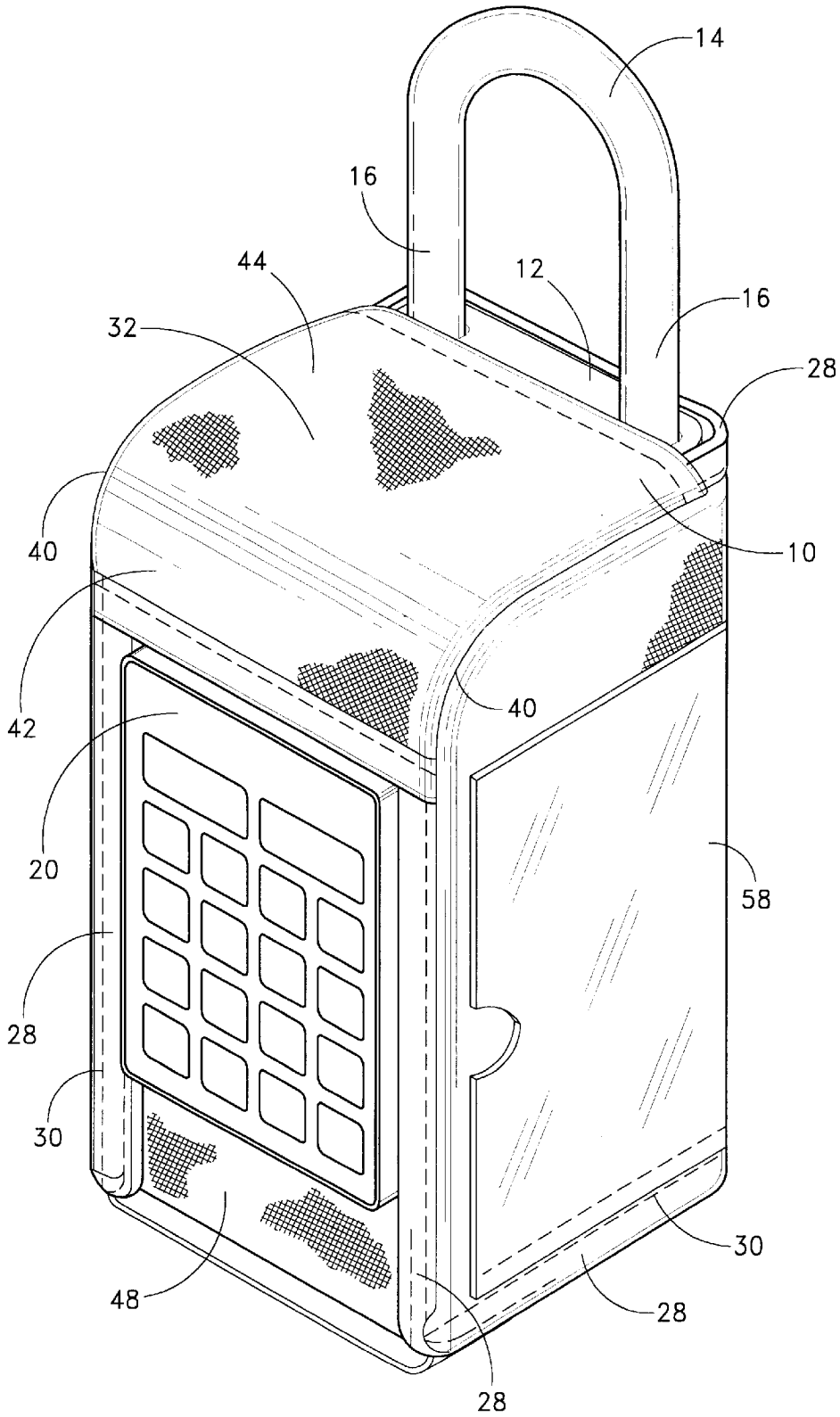
FIG. 1 is a top-right-front perspective view of a preferred embodiment of the protective lock box cover according to the present invention, illustrating the cover in place around a standard realtor's lock box.

FIG. 1 illustrates a preferred embodiment of the protective lock box cover 10 disposed about a standard modem lock box 12. The lock box 12 is shaped substantially as a six-sided rectangular box having top, bottom, front, back, left side and right side panels. A substantially U-shaped shackle 14 projects upwardly from the top panel. Posts 16 of the shackle 14 are received in mating ports (not shown) that project into the lock box 12 through the top panel. The U-shaped shackle 14 is adapted to be placed around, for example, a door knob in order to secure the lock box 12 to a property that is for sale. An interior key compartment 18 (FIG. 3) holds a key that is used to access the property. For example, the key compartment 18 may hold a key for the front door from which the box 12 hangs. The front panel of the lock box 12 includes a combination keypad 20. When the proper combination is entered into the keypad 20, the key compartment 18 ejects from the lower panel, allowing access to the key. Those of skill in the art will appreciate that the lock box 12 need not include a keypad 20. The lock box may instead include an alternative means for accessing the interior of the lock box, such as the examples discussed above. For such lock boxes, the cover 10 can be modified as appropriate to provide openings for leaving the access means exposed.

Figure 2A:
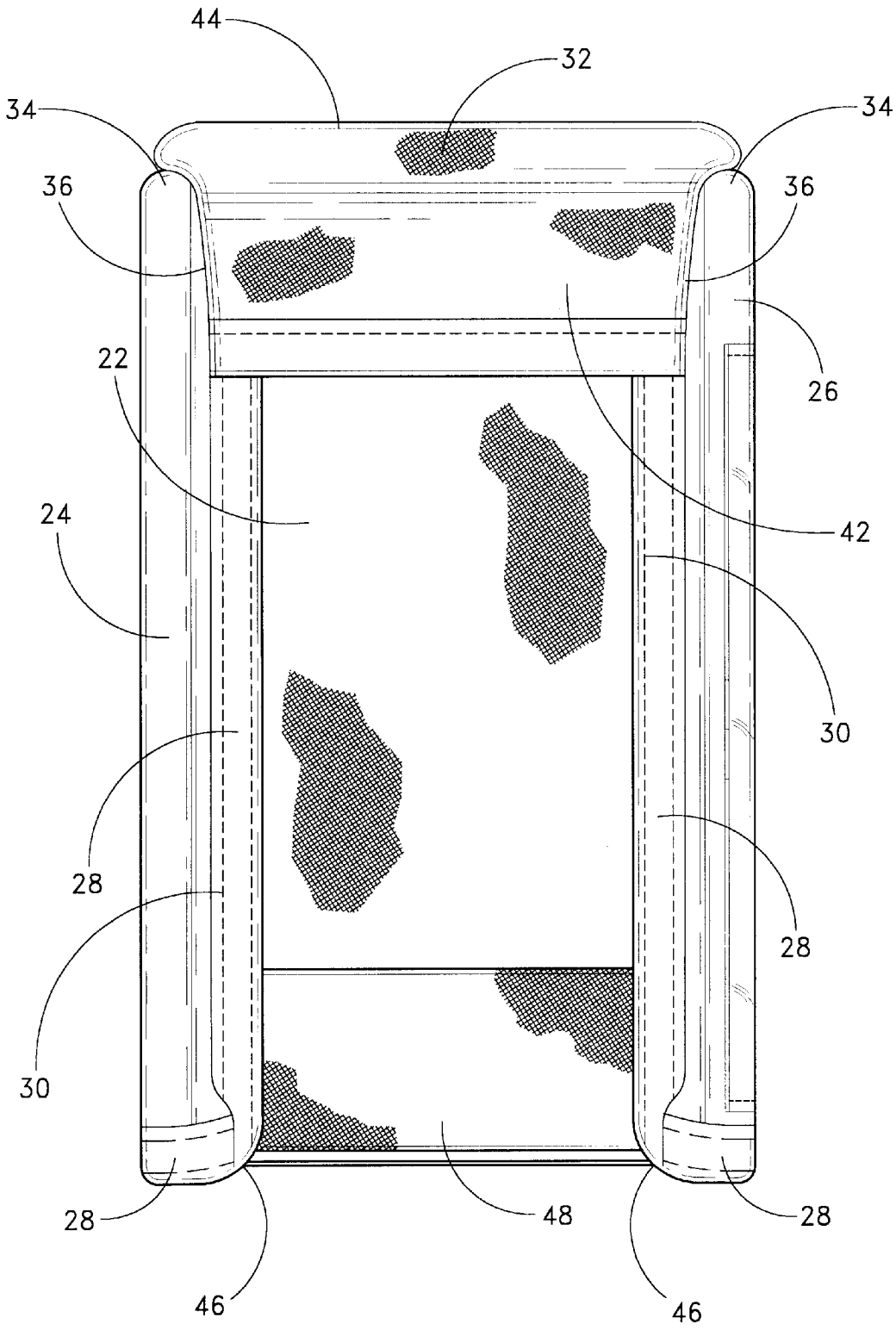
FIG. 2A is a front elevation view of the protective lock box cover of FIG. 1.
Figure 2C:
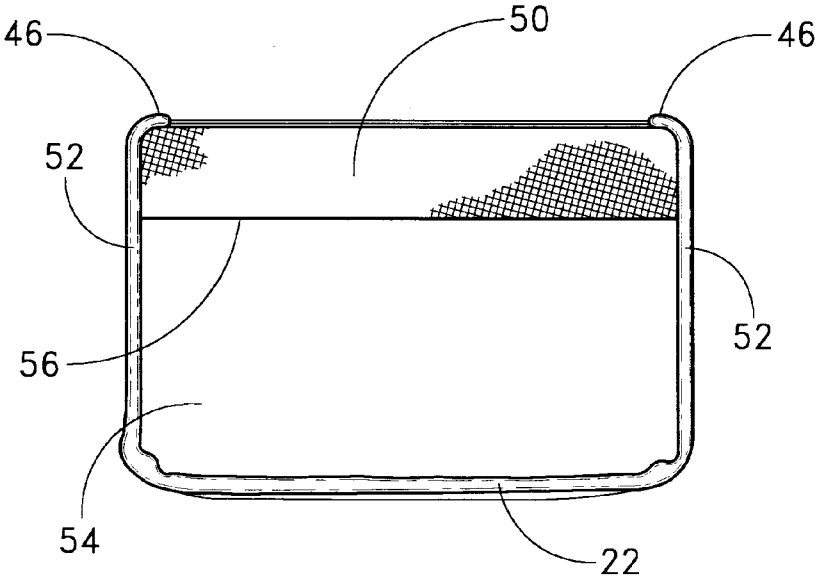
FIG. 2C is a bottom plan view of the protective lock box cover of FIG. 1.
Figure 2B:
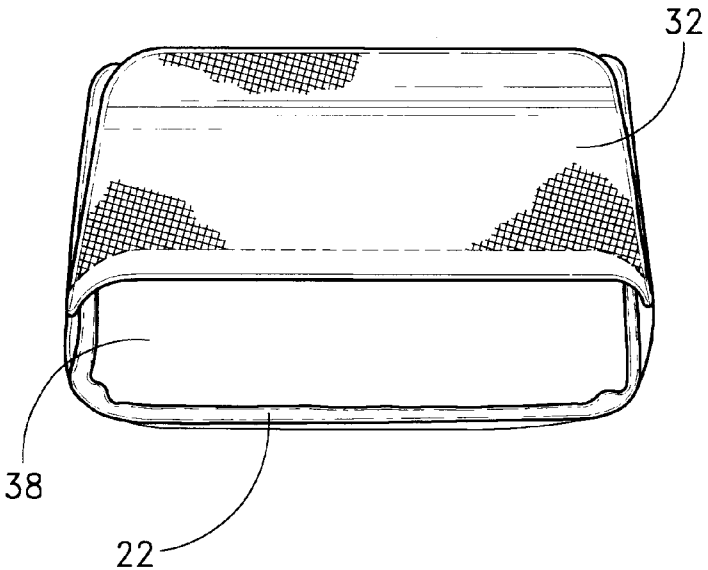
FIG. 2B is a top plan view of the protective lock box cover of FIG. 1.

The cover 10 comprises rear 22 (FIGS. 2A–2C), a left-side panel 24 and right side panel 26 (FIG. 2A), each adapted to rest against the rear, left side and right side panels, respectively, of the lock box 12. Each of these panels 22, 24, 26 preferably comprises a resilient material, such as neoprene or foam, for example. Preferably, the resilient material is sandwiched between two layers of fabric, such as nylon, for example. In the pictured embodiment, the inner and outer layers of fabric of the three panels 22, 24, 26 each comprise one continuous sheet. A separate piece of fabric 28 wraps around the edges of the fabric comprising the panels 22, 24, 26. Stitching 30 secures this separate piece 28 to the two fabric layers and secures the two fabric layers to one another, thereby forming a fabric envelope containing the resilient layer.

The envelope is divided into three separate compartments by two rows of stitching (not shown). A first row of stitching traces a border between the rear panel 22 and the left-side panel 24, and a second row of stitching traces a border between the rear panel 22 and the left-side panel 26. Each compartment preferably contains a separate piece of resilient material, such that the fabric envelope is easily foldable along the rows of stitching. One of skill in the art will appreciate that these three panels 22, 24, 26 could also be constructed in a variety of alternative ways. For example, each panel could be constructed separately, and the separate panels sewn together, rather than using two continuous sheets of fabric. Alternatively, each panel could comprise a resilient layer with a single layer of fabric sewn or otherwise attached to one surface. In such a configuration, the fabric layer, which is more durable than the resilient layer, preferably comprises the outer layer of the cover 10. Alternatively, the cover 10 may comprise only a single resilient layer, without any protective fabric layer.

A top/front edge panel 32 (FIGS. 1, 2A and 2B) is secured to the top edges 34 and front edges 36 (FIG. 2A) of the left-side panel 24 and right side panel 26. A width of the panel 32 is substantially equal to a width of the rear panel 22. A substantially rectangular gap 38 (FIG. 2B) separates the top/front edge panel 32 from the rear panel 22. The U-shaped shackle 14 of the lock box 12 protrudes through this gap 38 when the cover 10 is disposed about the lock box 12. The top/front edge panel 32 adjoins the top edge 34 of the left-side panel 24 and right side panel 26 forward to a top/front corner 40 (FIG. 1) of each. The top/front edge panel 32 continues along the front edge 36 of each side panel 24, 26 for a short distance. This front facing portion 42 (FIGS. 1 and 2A) of the top/front edge panel 32 covers an upper portion of a front face of the lock box 12 when the cover 10 is disposed about the lock box 12.

One of skill in the art will appreciate that the top/front edge panel 32 may adopt a number of other configurations. For example, the top facing portion 44 of the panel 32 and the front facing portion 42 of the panel 32 may comprise separate panels. Alternatively, the panel 32 may comprise only a top facing portion, or only a forward facing portion. Further, the panel 32 in the illustrated embodiment is attached to the side panels 24, 26 with stitching. Alternative methods of attaching the panel 32 to the side panels could also be used. For example, the panel 32 could be attached to the side panels 24, 26 with glue, buttons, snaps or hook and loop fastener. The configuration of the pictured embodiment should in no way be interpreted as limiting.

A pair of lower front straps connect lower front corners 46 (FIGS. 2A and 2C) of the left side panel 24 and right side panel 26. A front-facing strap 48 (FIGS. 1 and 2A) is connected just above the corner 46 of each panel 24, 26 and adjoins a short length of the front edge 36 of each panel 24, 26. A bottom-facing strap 50 (FIG. 2C) is connected just below the corner 46 of each panel 24, 26 and adjoins a short length of the bottom edge 52 of each panel 24, 26. A width of each strap 48, 50 is substantially equal to the width of the rear panel 22. The straps 48, 50 are preferably constructed of a fabric that stretches, but returns back to a pre-stretched length when the stretching force is removed. A preferred material is elasticized nylon.

The illustrated configuration of the straps 48, 50 is merely exemplary. The straps 48, 50 could, for example, be joined to one another to comprise one continuous piece, rather than two separate pieces. Alternatively, one of the straps could be eliminated. Further, although the straps 48, 50 in the illustrated embodiment are both sewn to the side panels 24, 26, the straps could be joined to the side panels 24, 26 using other methods of attachment. For example, the straps could be glued to the side panels 24, 26, or they could be attached using removable fasteners such as buttons, snaps or hook and loop fastener.

A bottom end of the cover 10 comprises a rectangular opening 54 (FIG. 2C) bordered by lower edges 52 of the rear panel 22, left-side panel 24 and right-side panel 26 and a rear edge 56 of the bottom-facing strap 50. When the elastic straps 48, 50 are stretched, the cover 10 thus slides easily over the top of the box 12 and fits snugly about the outside of the box 12. The left-side panel 24, rear panel 22, and right-side panel 26 rest against their respective panels of the lock box 12. The top facing portion 44 of the top/front panel 32 rests against the top panel of the lock box 12, while the front facing portion 42 of this panel 32 rests against the front panel of the lock box 12. The shackle 14 protrudes through the gap 38 between the rear panel 22 and the top/front panel 32. The cover 10 thus provides a protective buffer around all edges and corners of the lock box 12. The cover 10 protects both the lock box 12 and objects that contact the lock box 12 from damage.

Figure 3:
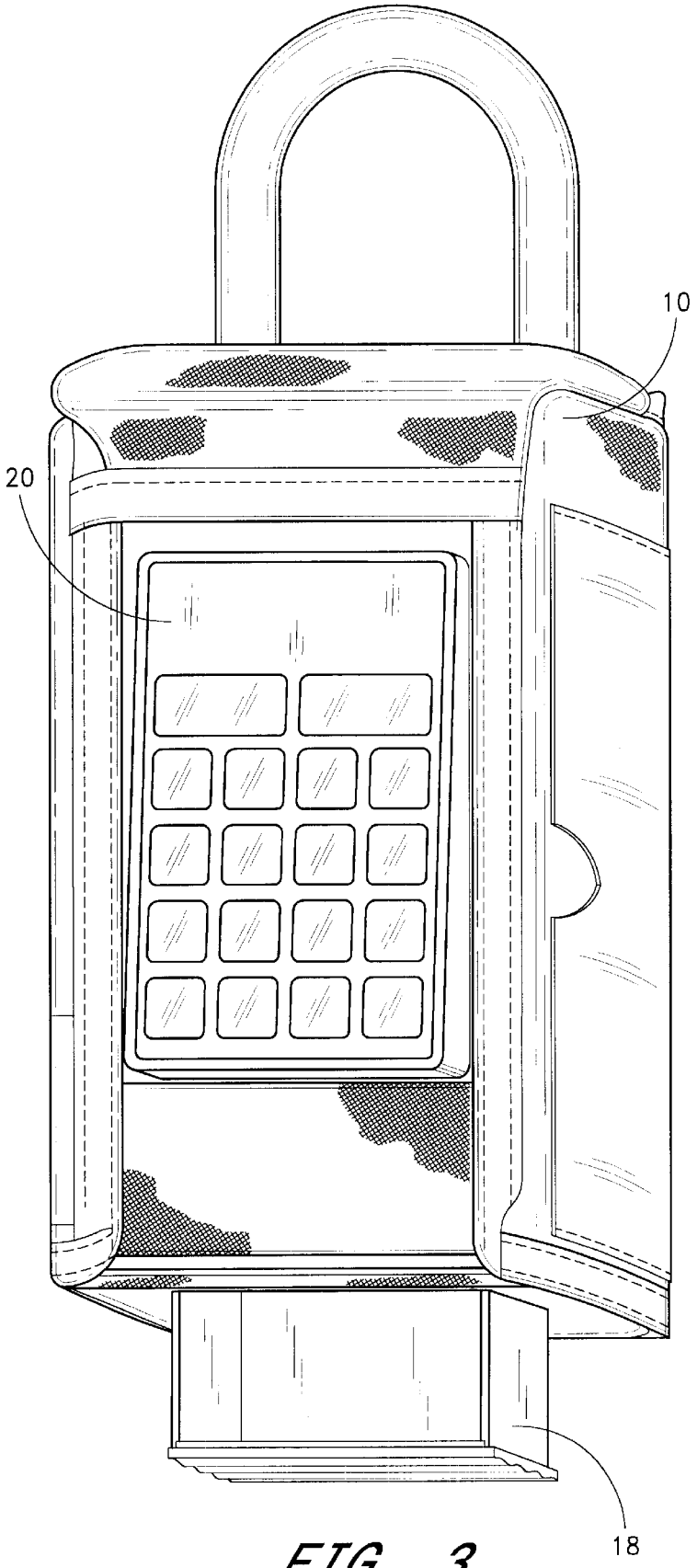
FIG. 3 is a bottom-right-front perspective view of the protective lock box cover of FIG. 1, illustrating the cover in place around a standard realtor's lock box with the key compartment of the lock box open.

Because the bottom of the cover 10 includes a large opening 54, the key compartment 18 of the lock box 12 is unobstructed. As shown in FIG. 3, when a real estate agent enters the proper code on the key pad 20, the key compartment 18 ejects downward from the lock box 12. By removing the key from the key compartment 18, the real estate agent is able to access the property for sale.

Figure 2D:
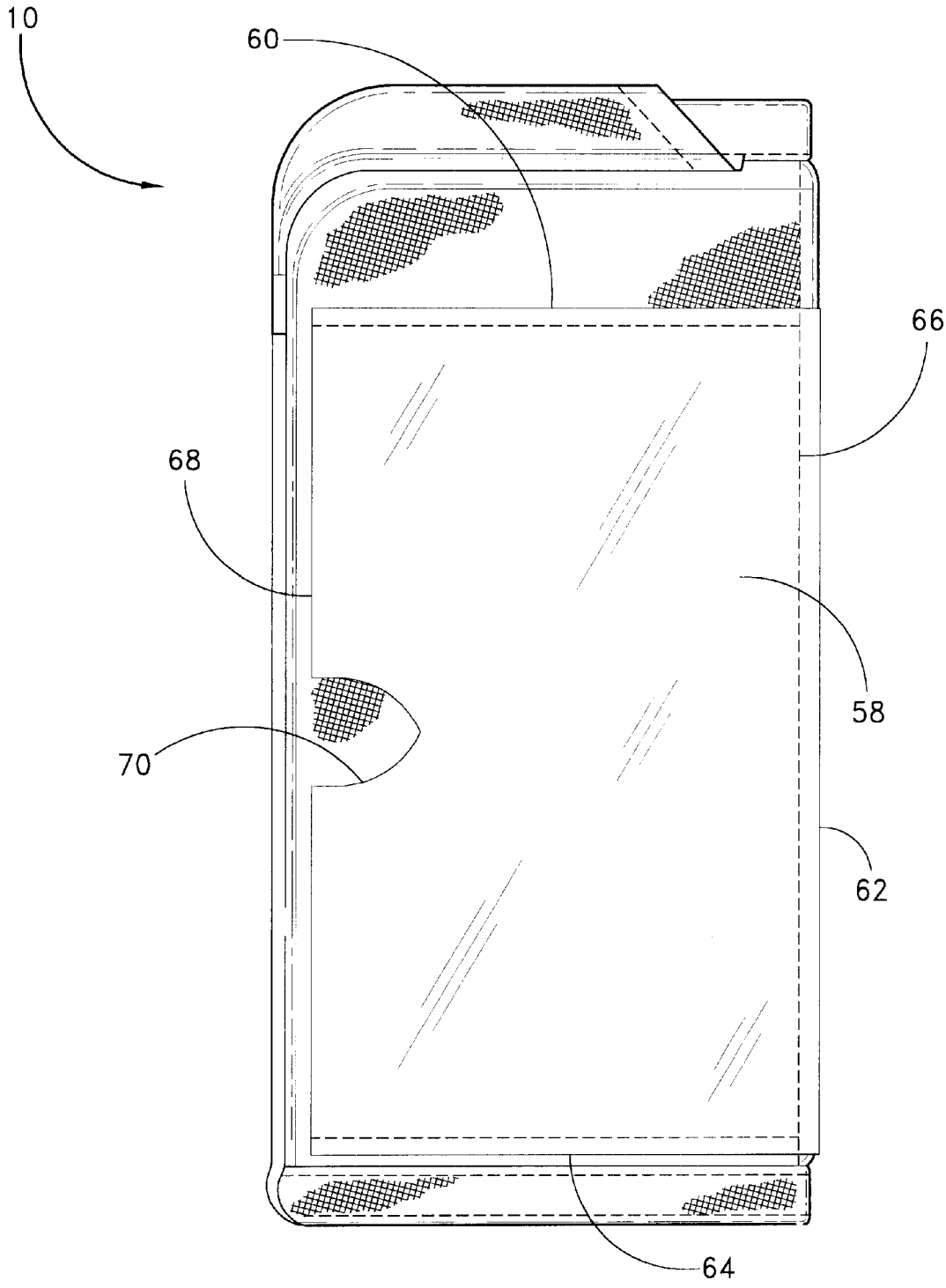
FIG. 2D is a right-side elevation view of the protective lock box cover of FIG. 1.

As shown in FIGS. 1 and 2D, the cover 10 preferably includes a sleeve 58 on at least one panel. The sleeve 58 advantageously holds business cards displaying the real estate agent's name and contact information. Thus, when a potential buyer visits a property on his or her own, if he or she is interested in talking to the agent who is handling the sale of that property, he or she can take the agent's business card from the sleeve 58. Alternatively, the sleeve 58 may hold a card or cards displaying information about the property for sale, advertisements, etc.

In the illustrated embodiment, the sleeve 58 is located on the left-side panel 26. Those of skill in the art will appreciate, however, that the sleeve 58 could be located on any of the panels of the cover 10. Preferably, the sleeve 58 is substantially rectangular and sized to be a little larger than a standard business card. Three edges 60, 62, 64 (FIG. 2D) of the sleeve 58 are secured to the left-side panel 26. The edges 60, 62, 64 may be secured by stitching 66, by an adhesive, or by any other suitable means. An interior space between the sleeve 58 and the left-side panel 26 is accessible beneath the fourth, unattached, edge 68. The fourth edge 68 preferably includes at least one indentation 70 to facilitate grasping the contents of the sleeve 58. The sleeve 58 preferably is made from a transparent material, such as plastic, so that the contents of the sleeve 58 are visible to prospective buyers.

SCOPE OF THE INVENTION

The above presents a description of the best mode contemplated for the present protective lock box cover, and of the manner and process of making and using it, in such full, clear, concise, and exact terms as to enable any person skilled in the art to which it pertains to make and use this protective lock box cover. This protective lock box cover is, however, susceptible to modifications and alternate constructions from that discussed above which are fully equivalent. Consequently, it is not the intention to limit this protective lock box cover to the particular embodiments disclosed. On the contrary, the intention is to cover all modifications and alternate constructions coming within the spirit and scope of the protective lock box cover as generally expressed by the following claims, which particularly point out and distinctly claim the subject matter of the protective lock box cover.

What is claimed is:

1. A protective cover for a realtor's lock box, the cover comprising:

a rear panel;

a right-side panel adjacent a first edge of the rear panel;

a left-side panel adjacent a second edge of the rear panel opposite the first edge;

at least one strap connected at a first end adjacent a lower-front corner of the right-side panel and connected at a second end to a lower-front corner of the left-side panel, such that a bottom end of the cover comprises an opening bounded on a first side by the strap and bounded on a second side by a lower edge of the rear panel; and a second strap connected at a first end adjacent a lower-front corner of the right-side panel and connected at a second end to a lower-front corner of the left-side panel.

2. The protective cover of claim 1, wherein a face of one strap faces downward, and a face of the other strap faces forward.

* * * * *

UNITED STATES PATENT AND TRADEMARK OFFICE

CERTIFICATE OF CORRECTION

PATENT NO. : 6,526,786 B1
DATED : March 4, 2003
INVENTOR(S) : Debra L. Kayoda

It is certified that error appears in the above-identified patent and that said Letters Patent is hereby corrected as shown below:

Column 1,
Lines 61 and 67, please replace “modem” with -- modern --.

Column 2,
Line 14, please replace “modem” with -- modern --.

Column 3,
Line 5, please replace “modem” with -- modern --.

Signed and Sealed this

Twentieth Day of January, 2004

JON W. DUDAS
*Acting Director of the United States Patent and Trademark Office*